US007337646B2

(12) United States Patent
Aoyagi et al.

(10) Patent No.: US 7,337,646 B2
(45) Date of Patent: Mar. 4, 2008

(54) METHOD AND DEVICE FOR MANUFACTURING SYNTHETIC RESIN COATED METAL CAN BODY

(75) Inventors: Mitsuhiko Aoyagi, Yokohama (JP); Norihito Saiki, Yokohama (JP); Hidekazu Tomaru, Yokohama (JP)

(73) Assignee: Toyo Seikan Kaisha, Ltd., Tokyo (JP)

( * ) Notice: Subject to any disclaimer, the term of this patent is extended or adjusted under 35 U.S.C. 154(b) by 0 days.

(21) Appl. No.: 10/582,939

(22) PCT Filed: Dec. 6, 2004

(86) PCT No.: PCT/JP2004/018126

§ 371 (c)(1),
(2), (4) Date: Jun. 15, 2006

(87) PCT Pub. No.: WO2005/058520

PCT Pub. Date: Jun. 30, 2005

(65) Prior Publication Data

US 2007/0119224 A1 May 31, 2007

(30) Foreign Application Priority Data

Dec. 17, 2003 (JP) ..... 2003-419338

(51) Int. Cl.
*B21D 22/21* (2006.01)
*B21D 22/28* (2006.01)
*B21D 51/26* (2006.01)

(52) U.S. Cl. ..... 72/349; 72/379.4

(58) Field of Classification Search ..... 72/347, 72/349, 379.4

See application file for complete search history.

(56) References Cited

U.S. PATENT DOCUMENTS 2,611,475 A * 9/1952 Slater ..... 72/327

(Continued)

FOREIGN PATENT DOCUMENTS

GB 1517732 A 7/1978

(Continued)

OTHER PUBLICATIONS

International Search Report mailed Mar. 22, 2005 of International Application PCT/JP2004/018126.

*Primary Examiner*—Dmitry Suhol
(74) *Attorney, Agent, or Firm*—Westerman, Hattori, Daniels & Adrian, LLP.

(57) ABSTRACT

A method and a device for manufacturing a synthetic resin coated metal can body capable of drawing and ironing the synthetic resin coated metal can body with a large processing quantity without causing can body breakage. First and second ironings are conducted to the side wall of a redrawn can (20) formed by drawing a thermoplastic resin-coated aluminum sheet (1) on both surfaces by a first ironing die (14) and a second ironing die (15) in that order according to the pressing-in of a punch (11) with such processing quantities that sheet thickness reduction ratios from an original sheet thickness come within the rages of 35 to 55% and 60 to 75% respectively for manufacturing a metal can body. Since the coated layer of a thermoplastic resin acts on a metal body in a direction for preventing the metal body from being broken (ruptured), processing conditions for ironing are relieved, and even if an ironing with a high sheet thickness reduction ratio is performed, an ironing capable of maintaining quality is allowed without causing the can body breakage in a first step can (21) and a second step can (22).

16 Claims, 3 Drawing Sheets

U.S. PATENT DOCUMENTS 4,541,265 A * 9/1985 Dye et al. ..... 72/349
4,962,659 A * 10/1990 Imazu et al. ..... 72/349
5,105,645 A * 4/1992 Kobayashi et al. ..... 72/348
5,179,854 A 1/1993 Matsui et al.
5,249,447 A * 10/1993 Aizawa et al. ..... 72/46
5,333,484 A * 8/1994 Mine et al. ..... 72/349
5,544,517 A * 8/1996 Shimizu ..... 72/349
5,778,722 A * 7/1998 Saiki et al. ..... 72/347
6,857,304 B2 * 2/2005 Enoki ..... 72/348

FOREIGN PATENT DOCUMENTS

JP 2002-178049 A 6/2002
JP 2003-19518 A 1/2003

* cited by examiner

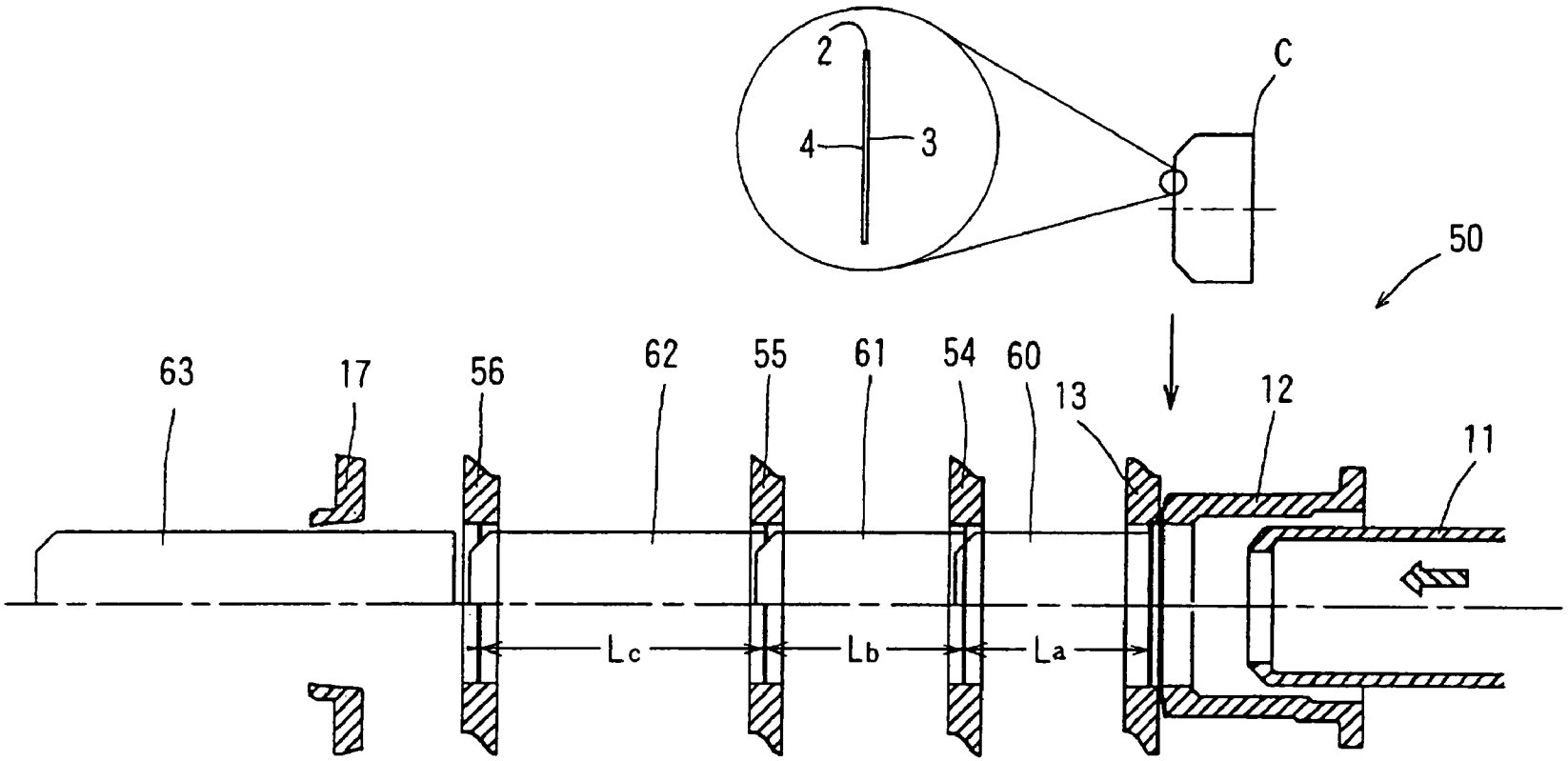
PRIOR ART Fig. 3

METHOD AND DEVICE FOR MANUFACTURING SYNTHETIC RESIN COATED METAL CAN BODY

TECHNICAL FIELD

The present invention relates to a method and a device for manufacturing a synthetic resin coated metal can body by conducting drawing and ironing of a metal sheet by using a punch and an ironing die.

BACKGROUND ART

Drawn and ironed metal cans such as aluminum two-piece cans or steel two-piece cans formed by integrally molding a can body and a can bottom section by drawing and ironing and then seaming a lid to the circumference of the open section of the can body have been widely used in the past. Metal can bodies for such two-piece cans have been manufactured by deep drawing a round sheet punched out from a flat sheet of aluminum or steel, forming a cup body in which a bottom section is integrated with a side wall, and then conducting ironing of the side wall of the cup body. By conducting ironing of the side wall, the thickness of the side wall of the cup body is reduced and a drawn and ironed metal can is formed by using the reduced quantity of metal materials.

The ironing is conducted by draw ironing in a wet state using a cooling and lubricant agent, that is, a coolant. The can molded by a wet molding process requires washing equipment and also environmental protection equipment, such as wastewater treatment equipment.

A synthetic resin coated aluminum can body or a synthetic resin coated steel can body (referred to hereinbelow simply as "resin coated can body") in which a synthetic resin film such as a polyester film is laminated on both surfaces of a metal sheet has been suggested (See the patent document 1) because in such drawn and ironed metal cans, a coating on the inner surface for ensuring corrosion resistance of the inner surface of the can is not required and the can has excellent ability to preserve the flavor of its contents. Furthermore, deep drawing and ironing are conducted in a dry state without using a coolant, that is, a cooling and lubricant agent. This processing is called dry molding, and because a cooling and lubricant agent is not used, the manufacturing process is simplified and speed thereof is increased. Furthermore, because such a processing method reduces environmental load, it can be also referred to as an environmentally friendly method. Moreover, when printing is conducted on the front surface of the can body, the printing ink is not repelled by a lubricating film and adequate printing can be conducted. A resin coated can body is continuously manufactured at a high speed as a seamless can body, for example by a process in which a resin coated aluminum sheet in which a thermoplastic polyester resin is coated on both surfaces of an aluminum sheet is coated on the front surface thereof with a lubricant agent, then a cup body is formed by drawing in a dry state, and then one-stroke ironing of the cup body thus obtained is conducted in a dry state by using a punch together with a ring-shaped ironing die. It has also been suggested to circulate a heating liquid inside the punch and ring-shaped die before the continuous can manufacturing process is started and cause the flow of cooling liquid inside the punch and ring-shaped die immediately before and immediately after the continuous can manufacturing process is started, thereby maintaining the appropriate temperature of the punch surface and, at the same time, preventing the excess increase in can temperature at the initial stage of deep drawing and ironing, so that continuous ironing can be conducted.

Patent Document 1: Japanese Patent Application Laid-open No. 2002-178048, Paragraphs 0028-0035, FIGS. 3-6

FIG. 3 shows an example of the conventional process for manufacturing a metal can by deep drawing and ironing of a metal sheet such as aluminum sheet and an example of a general structure of the conventional manufacturing device. A deep drawing and ironing device 50 shown in FIG. 3 comprises a cylindrical punch 11, a cylindrical blank holder 12 into which the punch 11 can be inserted, an annular redrawing die 13 disposed in the vicinity of the end side of the blank holder 12 in the processing direction, a first ironing die 54, a second ironing die 55, and a third ironing die 56 disposed successively with a spacing therebetween at the distal end side of the redrawing die 13, and a stripper 17 disposed at the distal end side of the third ironing die 56. Those punch 11, blank holder 12, ironing dies 54 to 56, and stripper 17 are installed in a row on the same central axis line. A metal sheet is usually molded into a shallow cup C with a cupping press (cupper) that is not shown in the figure and supplied to the deep drawing and ironing device 50. When the punch 11 is inserted through the redrawing die 13, the cup C, which is sandwiched in an annular fashion and held by the blank holder 12 and the redrawing die 13 is molded by drawing into a redrawn can 60. Then, by inserting the punch 11, first to third ironings are carried out successively with the first ironing die 54 to third ironing die 56 on the side wall of the redrawn can 60 and the respective first-step can 61 to third-step can 63 are molded. The distance La between the redrawing die 13 and the first ironing die 54 is set with consideration for the length (length of the side wall) of the redrawn can 60, and the distance Lb between the first ironing die 54 and the second ironing die 55 and the distance Lc between the second ironing die 55 and the third ironing die 56 are set with consideration for the length of the first-step can 61 obtained in the first ironing process and the length of the second-step can 62 obtained in the second ironing process (both are the lengths of the side wall).

Because aluminum is a metal material with mechanical properties, such as strength, r value, and limit draw ratio, inferior to those of steel, a can body breakage, in which the can body is ruptured, easily occurs during drawing and ironing accompanied by large deformation. Therefore, a limitation is inevitably placed on the processing amount and processing speed in the process of drawing and ironing an aluminum sheet, and the speed in manufacturing an aluminum two-piece can and the gage-down of the material are also restricted.

As shown by an enlarged partial cross section of the cup C, when a drawn and ironed can is molded so that a sheet thickness reduction ratio from the original sheet thickness of the side wall is 60 to 80% by using a cup C manufactured from an aluminum sheet having no resin coating, the ironing ratio per one cycle of ironing in one ironing die has to be suppressed to 40% or less in order to suppress the breakage ratio of the side wall to 10 ppm or less. Therefore, as described hereinabove, the redrawn can (cup body) 60 has to be subjected to multistage ironing by successively passing through the ironing dies arranged successively in a row in the punch stroke direction. As a result, the punch stroke length tends to increase. For example, in the case of a 500 mL can, the three ironing dies have to be held at an arrangement length of 295.5 mm or more. As a result, the punch stroke length increases to about 668 mm. If the stroke increases, the inertial force and impact force generated in the movable sections of the can manufacturing machine increases, thereby facilitating the fracture of machinery parts. As a result, the can manufacturing speed is difficult to increase. Furthermore, because a long stroke causes increase in punch vibrations, the can manufacturing accuracy decreases, e.g., thickness deviation occurs, and a negative effect is produced on the can quality. Decreasing the stroke length and conducting simultaneous ironing in a plurality of ironing dies can be considered as measures for resolving this problem, but such measures are difficult to employ because rupture occurs at the side wall of the can.

DISCLOSURE OF THE INVENTION

Problem to be Solved by the Invention

A phenomenon of a resin coating layer making contribution to the improved formability of a metal sheet during ironing of the metal sheet was observed in resin coated metal sheets in which the coating layer was present on both surfaces or in resin coated cup bodies that were formed from such sheets and had the coating layer on both the inner surface and the outer surface. Accordingly, with consideration for the contribution to the formability of the resin coating layer, there are problems that have to be resolved in terms of relaxing the processing conditions of metal sheet ironing in the manufacture of resin coated can body.

It is an object of the present invention to provide a method and a device for manufacturing a synthetic resin coated metal can body that make it possible to conduct ironing at a large processing quantity, without the can body breakage, while providing for the relaxation of processing conditions of metal sheet ironing by using the presence of the resin coating layer, to reduce ironing energy and shorten ironing time, to manufacture cans at a high speed, and also to shorten the punch stroke and reduce the drawing and ironing equipment in size.

Means for Solving Problem

In order to attain the above-described object, the present invention provides a method for manufacturing a synthetic resin coated metal can body by drawing a metal sheet coated on both surfaces with a thermoplastic resin to obtain a cup body and then ironing a side wall of the cup body by using a punch and a plurality of ironing dies, wherein the ironing comprises a first ironing conducted with respect to the side wall of the cup body with a first ironing die at a processing quantity such that a sheet thickness reduction ratio from an original sheet thickness is within a range of 35 to 55% and a second ironing conducted with a second ironing die with respect to the side wall, which has been subjected to the first ironing, at a processing quantity such that a sheet thickness reduction ratio from the original sheet thickness is within a range of 60 to 75%. Here, the drawing may also include redrawing. Furthermore, the original sheet thickness is the thickness of the flat sheet before the metal sheet is drawn to a cup body and is the thickness including the thermoplastic resin coating.

With this method for manufacturing a synthetic resin coated metal can body, the synthetic resin coated metal can body is manufactured by performing ironing with respect to a cup body that was formed from a metal sheet coated on both sides with a thermoplastic resin. However, in the first ironing process, which is implemented together with the punch with respect to the side wall of the cup body that has been coated with a thermoplastic resin on both the inner and the outer surface, the ironing is performed with the first ironing die at a processing quantity such that the sheet thickness reduction ratio from the original sheet thickness is within a range of 35 to 55%. Then, the second ironing is performed with the second ironing die with respect to the side wall, which was subjected to the first ironing, at a processing quantity such that the sheet thickness reduction ratio from the original sheet thickness is within a range of 60 to 75%. Because the coating layer of the thermoplastic resin acts in the direction of preventing the breakage (rupture) of the side wall of the cup body, which is the metal body, the processing conditions of ironing can be relieved, and ironing can be performed in which the quality is maintained, without the can body breakage in the cup body, even if the ironing is performed at a processing quantity with a high sheet thickness reduction ratio.

The present invention also provides a device for manufacturing a synthetic resin coated metal can body by using a punch and a plurality of ironing dies and ironing a side wall of a cup body obtained by drawing a metal sheet coated on both surfaces with a thermoplastic resin, wherein the plurality of ironing dies comprise a first ironing die for conducting first ironing at a processing quantity such that a sheet thickness reduction ratio from an original sheet thickness is within a range of 35 to 55% and a second ironing die disposed at a distance equal to or slightly larger than the length of the metal can body obtained in the first ironing from the first ironing die and conducting second ironing with respect to the side wall, that has been subjected to the first ironing, at a processing quantity such that a sheet thickness reduction ratio from the original sheet thickness is within a range of 60 to 75%. Here, the length of the metal can body means the length of the side wall of the can body that does not include a taper section (chime section) linking the can bottom and the side wall. Furthermore, the distance between the dies means the distance between two dies in a die-straight section position where ironing is conducted.

With this device for manufacturing a synthetic resin coated metal can body, the synthetic resin coated metal can body is manufactured by performing ironing with respect to a cup body that was formed from a metal sheet coated on both sides with a thermoplastic resin. However, in the first ironing process, which is implemented together with a punch with respect to the side wall of the cup body that has been coated with a thermoplastic resin on both the inner and the outer surface, the ironing is performed with the first ironing die at a processing quantity such that the sheet thickness reduction ratio from the original sheet thickness is within a range of 35 to 55%. The second ironing die is disposed at a slightly larger distance than the length of the metal can body obtained in the first ironing from the first ironing die. Therefore, the metal can body starts passing through the second ironing die immediately after passing through the first ironing die, and the second ironing is conducted with the second ironing die with respect to the side wall, that was subjected to the first ironing, at a processing quantity such that the sheet thickness reduction ratio from the original sheet thickness is within a range of 60 to 75%. Because the coating layer of the thermoplastic resin acts in the direction of preventing the breakage (rupture) of the side wall of the cup body, which is the metal body, the processing conditions of ironing can be relieved, and ironing can be performed in which the quality is maintained, without the can body breakage in the cup body, even if the ironing is performed at a processing quantity with a high sheet thickness reduction ratio. As described hereinabove, the ironing die comprises the first and the second ironing dies, and the two dies are disposed with a spacing slightly larger than the length of the metal can body obtained in the first ironing process. As a result, the two dies do not conduct simultaneous ironing of a leading edge and a trailing edge of a can in a certain can body, and the probability of thickness deviation or breakage caused by the die or punch core displacement is small. Furthermore, the distance between the two ironing dies is reduced to a minimum, thereby providing for improvement relating to the processing speed and space required for disposing the device.

In the method and device for manufacturing a synthetic resin coated metal can body, the first ironing die and the second ironing die can be single ironing dies. The first ironing die is an ironing die conducting the ironing independently, that is, composed of one ring-shaped ironing die. The first ironing die performs first ironing at a processing quantity such that the sheet thickness reduction ratio from the original sheet thickness is within a range of 35 to 55%. Because the processing quantity of the second ironing die is less than the processing quantity of the first ironing die, when the first ironing die is a single ironing die, the second ironing die also can be configured as a single ironing die.

In the method and device for manufacturing a synthetic resin coated metal can body, at least the first ironing die from among the first ironing die and the second ironing die is a composite ironing die comprising a leading side ironing die and a trailing side ironing die arranged in a row in an ironing direction. The first ironing die performs ironing at a processing quantity such that the sheet thickness reduction ratio from the original sheet thickness is within a range of 35 to 55%, and because this processing quantity is larger than the processing quantity of the second ironing die, the ironing is preferably distributed between the ironing dies by employing, as the first ironing die, a composite ironing die comprising a leading side ironing die and a trailing side ironing die arranged in a row in an ironing direction. Disposing the leading side ironing die and the trailing side ironing die of the composite ironing die adjacently is most effective for preventing the deviation of thickness or vibrations of the punch and for shortening the punch stroke. However, the distance between the dies can be also set within a range in which the ironing will be simultaneously conducted by the dies. In this case, the spacing between the leading side ironing die and the trailing side ironing die is preferably equal to or less than half the length of the side wall of the can body in the case where the processing is conduced only with the leading side ironing die for the deviation of thickness or vibrations of the punch. The second ironing die also can be a composite ironing die, similarly to the first ironing die, but because the processing quantity thereof is less than the processing quantity of the first ironing die, it can be a single ironing die.

In the method and device for manufacturing a synthetic resin coated metal can body, the ironing of the side wall performed with the leading side ironing die may be conducted at a processing quantity such that a sheet thickness reduction ratio from the original sheet thickness is within a range of 18 to 40%, and the ironing of the side wall performed with the trailing side ironing die may be conducted at a processing quantity such that the sheet thickness reduction ratio from the original sheet thickness is within a range of 35 to 55%. Because the processing quantity in the first ironing die comprising a composite ironing die may be increased with respect to the metal sheet and resin coating layer with a larger thickness prior to thickness reduction, the processing quantity of the leading side ironing die is preferably equal to or larger than half the processing quantity of the trailing side ironing die.

In the method and device for manufacturing a synthetic resin coated metal can body, the metal sheet may be an aluminum sheet. The moldability improvement action of the synthetic resin coating layer on the metal layer when the metal sheet coated with a synthetic resin on the surface is subjected to ironing is especially high with respect to aluminum that has mechanical properties inferior to those of steel.

In the method and device for manufacturing a synthetic resin coated metal can body, the thermoplastic resin preferably has a tensile modulus of elasticity of 1.45 to 11.8 GPa. By setting forth the tensile modulus of elasticity of the thermoplastic resin in the aforementioned range, the reinforcing action of the synthetic resin coating layer on the metal layer undergoing ironing can be sufficiently demonstrated. If the tensile modulus of elasticity of the thermoplastic resin is outside the range, the breakage occurrence ratio is increased and partial peeling in the thermoplastic resin layer and metal exposure on the inner surface of the can are observed.

In the method and device for manufacturing a synthetic resin coated metal can body, the thermoplastic resin is a polyester resin. With consideration for the above-described properties and strengthening action, it is preferred that the thermoplastic resin be a polyester resin. Examples of other suitable resins include polypropylene and Nylon.

In the method and device for manufacturing a synthetic resin coated metal can body, the thermoplastic resin is preferably coated on the metal sheet to a thickness of 5 to 50 μm on the side that is to be an inner surface side of the metal can body and to a thickness of 3 to 50 μm on the side that is to be an outer surface of the metal can body. When the film thickness of the thermoplastic resin is outside the aforementioned ranges, partial or significant peeling from the metal surface is observed in the thermoplastic resin.

Effect of the Invention

Because the method and device for manufacturing a synthetic resin coated metal can body in accordance with the present invention use the above-described features, in the first ironing conducted together with a punch with respect to the side wall of the cup body coated with a thermoplastic resin on both the inner surface and the outer surface, the ironing is conducted with a first ironing die at a processing quantity such that a sheet thickness reduction ratio from an original sheet thickness is within a range of 35 to 55% and then in the second ironing conducted by the second ironing die with respect to the side wall, which has been subjected to the first ironing, the ironing is conducted at a processing quantity such that a sheet thickness reduction ratio from the original sheet thickness is within a range of 60 to 75%. Because the coating layer of the thermoplastic resin acts in the direction of preventing the breakage (rupture) of the side wall of the cup body, which is the metal body, the can body breakage in the cup body can be avoided, ironing is so performed in which the quality is maintained, and a resin coated metal can body maintaining good quality may be obtained, even if the ironing is performed at a processing quantity with a high sheet thickness reduction ratio. Therefore, the processing limitations placed on the ironing process is relaxed and the number of ironing stages is reduced. As a result, the ironing energy reduction and ironing time shortening are realized and can manufacturing may be conducted at a high speed. Furthermore, in the manufacturing device, the punch stroke for ironing may be shortened correspondingly to the reduction in the number of ironing stages, and the drawing and ironing equipment may be reduced in size, and space may be saved.

BRIEF DESCRIPTION OF THE DRAWINGS

FIG. 3 shows an example of the conventional process for manufacturing a metal can by deep drawing and ironing of a metal sheet such as aluminum sheet and an example of a general structure of the conventional manufacturing device.

EXPLARATIONS OF LETTERS OR NUMERALS

Figure 1:
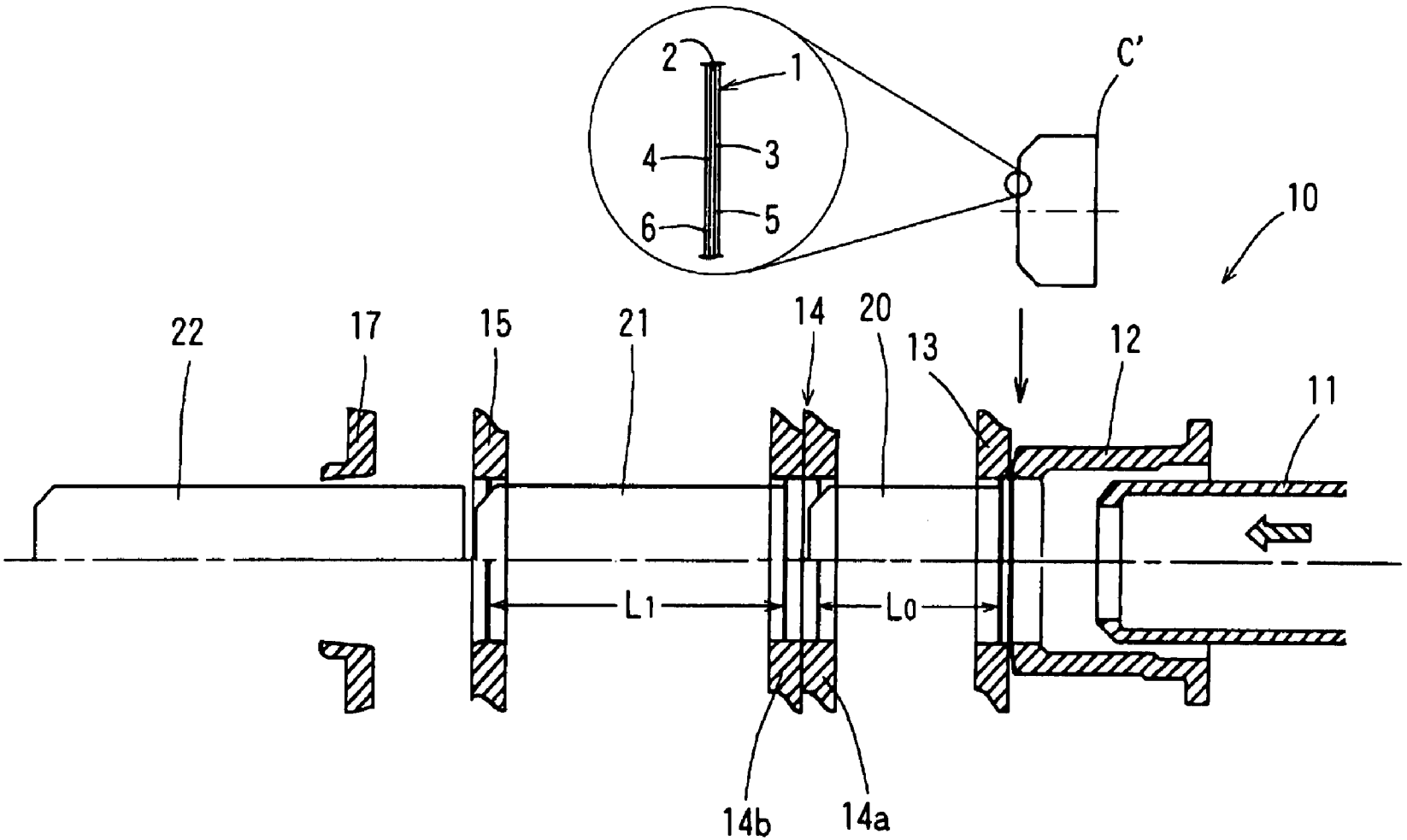
FIG. 1 is a schematic drawing showing an example of the process for manufacturing a synthetic resin coated metal can body by the method for manufacturing a synthetic resin coated metal can body in accordance with the present invention and an example of the device for manufacturing a synthetic resin coated metal can body in accordance with the present invention.

1: resin-coated aluminum sheet 2: aluminum sheet
3: inner surface of the aluminum sheet 2
4: outer surface of the aluminum sheet 2
5, 6: thermoplastic resin coating film
10: device for manufacturing a synthetic resin coated metal can body 11: punch
12: blank folder 13: redrawing die
14, 34: first ironing die
14*a*: leading side ironing die
14*b*: trailing side ironing die
15, 35: second ironing die 17: stripper
20: redrawn can 21: first step can
22: second step can
C, C': cup
L0: length of the redrawn can 20
L1: length of the first step can 21

BEST MODE FOR CARRYING OUT THE INVENTION

Embodiments of the method and device for manufacturing a synthetic resin coated metal can body in accordance with the present invention will be explained below with reference to the appended drawings. FIG. 1 is a schematic drawing showing an example of the process for manufacturing a synthetic resin coated metal can body by the method for manufacturing a synthetic resin coated metal can body in accordance with the present invention and an example of the device for manufacturing a synthetic resin coated metal can body in accordance with the present invention. In the embodiment shown in FIG. 1, part (ironing process) of the process for manufacturing a can body of the so-called two-piece can comprising a can body formed integrally with a can bottom and a lid body is shown.

In the device for manufacturing a synthetic resin coated metal can body shown in FIG. 1, a metal sheet subjected to drawing and ironing is a flat resin-coated aluminum sheet 1 comprising, as shown in an enlarged partial cross section of a cup C', an aluminum sheet 2 and thermoplastic resin coating films 5, 6 that were coated on both surfaces 3, 4 thereof. The resin coated aluminum sheet 1 is usually supplied as a cup C' in the form of a shallow cup punched in a cupping press (not shown in the figure) to a drawing and ironing device. With consideration for the below-described moldability improvement action, the thermoplastic resin coating films 5, 6 are preferably from a polyester resin, but examples of other thermoplastic resins satisfying each condition include polyester resins, polyester elastomers, polypropylene, and Nylon. A thermoplastic organic resin with a tensile modulus of elasticity of 1.45 to 11.8 GPa is coated as a coating film 5 with a thickness of 5 to 50 μm on the side of the aluminum sheet 2 that is to be the inner surface 3 of the metal can body, and the coating film 6 with a thickness of 3 to 50 μm on the side that is to be an outer surface 4 of the metal can body. When the film thickness and tensile modulus of elasticity are set within the above-described ranges and the bonding force with the aluminum sheet is set to be 200 g/15 mm or more in a combination of the aluminum sheet 1 and the synthetic resin coating films 5, 6, the moldability improvement action of the synthetic resin coating layer during ironing of the metal sheet material has been found especially effective with respect to aluminum with comparatively poor mechanical properties. If the tensile modulus of elasticity of the thermoplastic resin or adhesive strength of the aluminum sheet are outside the ranges, the can body breakage occurrence ratio is increased, the thermoplastic resin layer is partially peeled off, and metal exposure on the inner surface of the can is observed.

As shown in FIG. 1, the cup C' obtained by drawing a resin coated aluminum sheet having thermoplastic resin coating films 5, 6, on both surfaces in a press (not shown in the figure) is first subjected to drawing in a device for manufacturing a synthetic resin coated metal can body (referred to hereinbelow as "manufacturing device") 10, thereby forming a redrawn can 20. Then, ironing is performed in the manufacturing device 10 on the side wall of the redrawn can 20 by using the below-described punch 11 and a plurality of ironing dies 14, 15, thereby manufacturing a synthetic resin coated metal can body in a one-stroke mode in a dry state. In FIG. 1, similarly to FIG. 3, the cans 20 to 22 of each step are shown only by the upper half thereof above the central axial line.

Similarly to the conventional manufacturing device shown in FIG. 3, the manufacturing device 10 shown in FIG. 1, comprises a cylindrical punch 11, a cylindrical blank holder 12 into which the punch 11 can be inserted, an annular redrawing die 13 installed in the vicinity of the blank holder 12 on the front side in the processing direction, a first ironing die 14, a second ironing die 15, and a stripper 17 disposed in the order of description with a spacing toward the front side in the processing direction of the redrawing die 13, all the aforementioned components being installed in a row along the same central axial line. The punch 11 forms the resin coated aluminum sheet 1 (cup C') that is sandwiched in a ring-like fashion and held by the blank holder 12 and redrawing die 13 when it advances through the blank holder 12 and redrawing die 13 into a redrawn can 20 by (re)drawing. When the redrawn can 20 is pushed by the punch 11, the side wall of the redrawn can 20 is successively ironed by the first ironing die 14 and second ironing die 15, the resin coating and the metal are extended and a first step can 21 and a second step can 22 (metal can body) having reduced thickness and increased can length are successively molded.

The first ironing die 14 is disposed at a length L0 of the redrawn can 20 (strictly speaking, the length of the side wall) or at a slightly longer distance from the redrawing die 13. The first ironing die 14 together with the punch 11 perform first ironing of the cup C' comprising the resin coated aluminum sheet 1 at a processing quantity such that the sheet thickness reduction ratio from the original sheet thickness is within a range of 35 to 55%. Here, the sheet thickness reduction ratio is defined as a reduction ratio from the original sheet thickness. The first processing quantity of the processing conduced by the first ironing die 14 is set larger than the second processing quantity of the second ironing die. In the embodiment shown in FIG. 1, the first ironing die 14 is constructed as a composite ironing die comprising two ironing dies (a leading side ironing die 14*a* and a trailing side ironing die 14*b*) arranged closely in a row in an ironing direction, that is, the central axis line direction. With such a structure, the ironing operation performed by the first ironing die 14 can be divided between the ironing dies 14*a*, 14*b*. At this time, the thermoplastic resin coating films 5, 6 act in the direction of preventing the breakage, that is, the rupture of the side wall of the cup body, which is a metal body. Therefore, ironing may be conducted in which quality is maintained without causing a can body breakage in the redrawn can 20, even though the ironing is conducted at a processing quantity with a larger sheet thickness reduction ratio. Therefore, processing conditions of ironing can be relaxed.

As for the distribution of processing quantity between the leading side ironing die 14*a* and the trailing side ironing die 14*b* in the embodiment shown in FIG. 1, the processing quantity of the leading side ironing die 14*a* may be such that thickness reduction ratio from the original sheet thickness in the side wall is within a range of 18 to 40%, and the processing quantity of the trailing side ironing die 14*b* may be such that thickness reduction ratio from the original sheet thickness in the side wall is within a range of 35 to 55%. In the first ironing die 14 configured as a composite die, the processing quantity is increased with respect to the resin coating layer and side wall with a larger thickness prior to thickness reduction. Therefore, the processing quantity of the leading side ironing die 14*a* is preferably equal to or larger than half the processing quantity of the trailing side ironing die 14*b*.

The second ironing die 15 is disposed at a length L1 of the first step can 21 (strictly speaking, the length of the side wall) or at a slightly larger distance from the first ironing die 14. Therefore, the first step can 21 starts passing through the second ironing die 15 from the leading portion thereof immediately after passing through the first ironing die 14, and the second ironing is performed by the second ironing die with respect to the side wall that was subjected to the first ironing. The first ironing and the second ironing are not performed simultaneously, and an excess impact load does not act on the can or the punch 11. The second ironing die 15 together with the punch 11 perform the second ironing of the side wall of the first step can 21 at a processing quantity such that the sheet thickness reduction ratio from the original sheet thickness is within a range of 60 to 75%. The second ironing die 15 also can be a composite die similarly to the first ironing die 14, but in order to provide a processing quantity less than the processing quantity provided by the first ironing die 14 and to maintain the product quality by regulating thickness deviation in the metal can body, the second ironing die is preferably configured as a single ironing die.

It was experimentally confirmed that the side wall can be subjected to ironing such that the processing quantity in the first ironing die 14 and the processing quantity in the second ironing die 15 are within a range of the sheet thickness reduction ratio of 35 to 55% and 60 to 75%. Thus, it was confirmed that due to the presence of the synthetic resin coating layer, the processing restrictions relating to ironing may be relaxed and the can body breakage may be avoided even if ironing is conducted at a high processing quantity. Three ironing dies 54, 55, 56 (see FIG. 3) have been conventionally used for ironing, but this is unnecessary and the ironing may be conducted with two dies only: first ironing die 14 and second ironing die 15. As a result, the number of ironing stages is reduced, the processing energy is saved, and the processing time is shortened, thereby enabling the high-speed manufacturing of cans. Moreover, correspondingly to the minimization of the distance between the two ironing dies 14, 15 in the manufacturing device 10 and the reduction in the number of ironing stages, the stroke of the processing punch may be shortened. Therefore, the manufacturing device 10 may be decreased in size, the installation space may be saved, and the processing speed may be increased.

Figure 2:
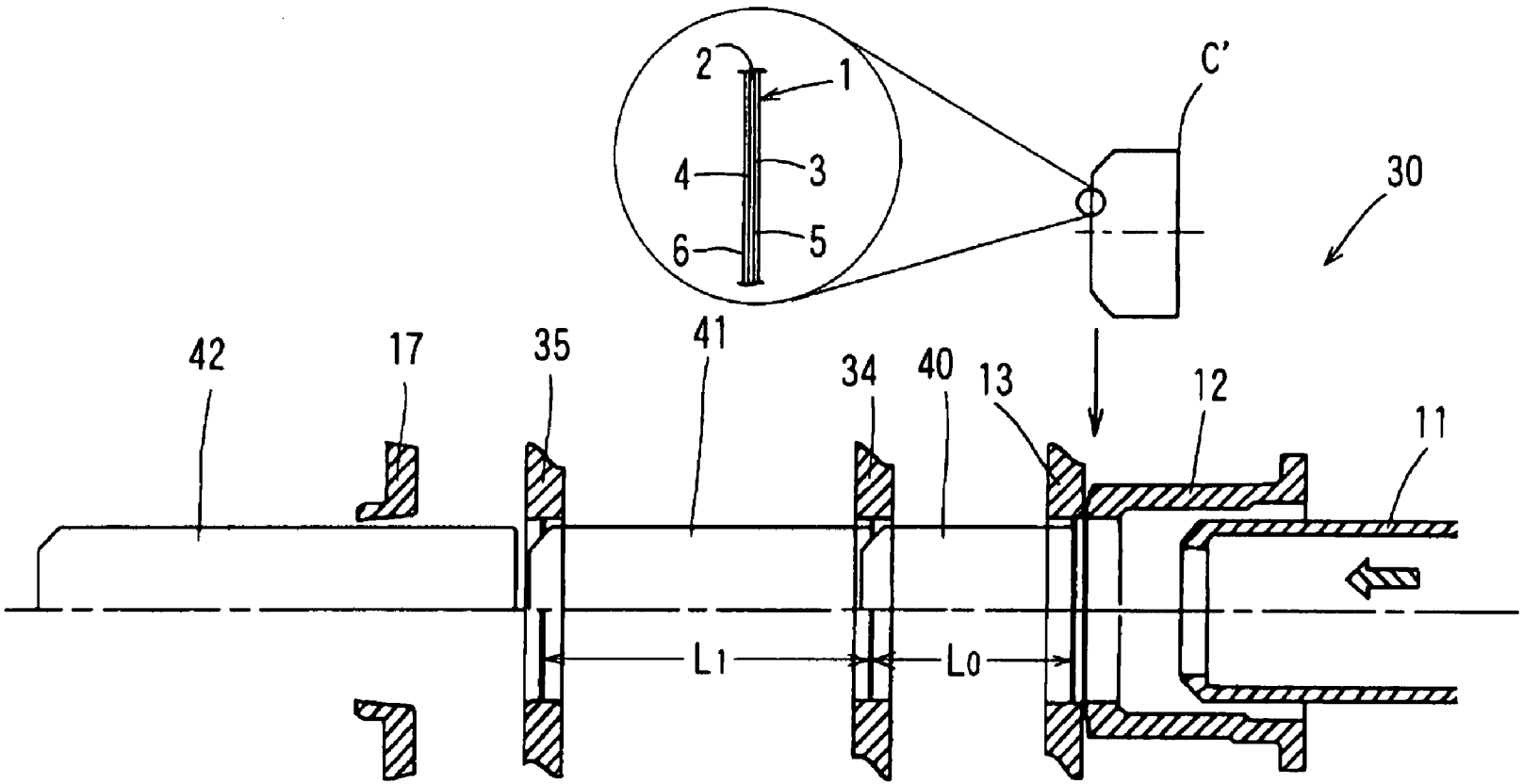
FIG. 2 illustrates another embodiment of the method and device for manufacturing a synthetic resin coated metal can body in accordance with the present invention.

FIG. 2 illustrates another embodiment of the method and device for manufacturing a synthetic resin coated metal can body in accordance with the present invention. The embodiment shown in FIG. 2 is structurally not different from the above-described embodiment, except that the configuration of the first ironing die is different. Therefore, structural elements performing the same functions are assigned with the same reference numerals, and redundant explanation thereof is omitted. In the embodiment shown in FIG. 2, a first ironing die 34 and a second ironing die 35 are configured as one ring-shaped ironing die, that is, as a single ironing die performing the ironing independently. The first ironing die 34 can perform the first ironing at a first processing quantity such that the sheet thickness reduction ratio from the original sheet thickness is within a range of 35 to 55%. The second processing quantity of the second ironing die 35 is less than the first processing quantity and is such that the sheet thickness reduction ratio from the original sheet thickness is within a range of 60 to 75%. Furthermore, similarly to the embodiment shown in FIG. 1, the deviation of thickness is regulated and product quality is maintained. Therefore, it is preferred that the second ironing die 35 is also configured as a single ironing die.

Test conditions and evaluation results relating to ironing conducted in Working Examples 1 to 16 and Comparative Examples 1 to 12 of manufacturing a synthetic resin coated metal can body in accordance with the present invention are shown in Table 1. Items in the lateral direction of Table 1, include a can size, tool and molding conditions, organic resin coating film, and evaluation results. As for the can size, there are a 350 mL can and a 500 mL can with a can diameter of 211 (nominal diameter), a lid diameter of 204 (nominal diameter) and a can height of 122 mm and 167 mm, respectively. The tool and molding condition items include a punch stroke, a first ironing mode, each sheet thickness reduction ratio in a composite die, and a sheet thickness reduction ratio in the final ironing die. The items relating to the organic resin coating film include the type, thickness, tensile elasticity, and adhesive strength of the resin on the inner surface. In the resin coated metal can body, the coated synthetic resin film can be easily damaged and coating defects such as pinholes easily occur therein. For this reason, the coating film has to be prevented form damage in the manufacturing process in order to ensure quality such as corrosion resistance and flavor. For this reason, the evaluation results include the can body breakage occurrence ratio, rollback (buckling occurring close to the opening edge when the molded can is pulled out from the punch), peeling of the organic resin coating material, and metal exposure on the inner surface of the can.

Conditions of tests on manufacturing synthetic resin coated metal can bodies and evaluation results

| | | Tool, molding conditions | | | | | Organic resin coating | | | | Evaluation results | | | |
|---|---|---|---|---|---|---|---|---|---|---|---|---|---|---|
| | | | | Each sheet thickness reduction ratio of composite ironing die | | | | | | | | | | |
| | Can size | Punch stroke length | Initial ironing mode | Sheet thickness reduction ratio in ironing die on leading side (%) | Sheet thickness reduction ratio in ironing die on trailing side (%) | Final die Sheet thickness reduction ratio from original sheet thickness on side wall of final cup (%) | Type | Thickness (μm) inner surface/outer surface | Tensile modulus of elasticity (GPa) | Bonding strength of resin on inner surface (g/15 mm width) | Breakage occurrence ratio | Rollback | Peeling of organic resin coating material | Metal exposure on inner surface of can (mA) |
| Working Example 1 | 350 mL | 21 inch | Single | 42 | — | 63 | PET/IA | 16/16 | 1.48 | 250 | 0 | None | No peeling | 0.00 |
| Working Example 2 | 350 mL | 21 inch | " | 42 | — | 63 | " | " | 3.00 | " | 0 | None | No peeling | 0.00 |
| Working Example 3 | 350 mL | 21 inch | Composite ironing | 20 | 42 | 63 | " | " | " | " | 0 | None | No peeling | 0.00 |
| Working Example 4 | 350 mL | 21 inch | Composite ironing | 20 | 42 | 67 | " | 20/45 | " | " | 0 | None | No peeling | 0.00 |
| Working Example 5 | 350 mL | 21 inch | Composite ironing | 20 | 42 | 67 | " | 45/20 | " | " | 0 | Very small | No peeling | 0.00 |
| Working Example 6 | 350 mL | 21 inch | Composite ironing | 25 | 53 | 72 | PET/NDC | 20/20 | 11.2 | " | 0 | None | No peeling | 0.00 |
| Working Example 7 | 350 mL | 21 inch | Composite ironing | 25 | 53 | 72 | homo PET | 20/20 | 10.0 | 205 | 0 | None | No peeling | 0.00 |
| Working Example 8 | 500 mL | 23 inch | Single | 49 | — | 67 | PET/IA | 16/16 | 3.00 | 250 | 0 | None | No peeling | 0.00 |
| Working Example 9 | 500 mL | 23 inch | Composite ironing | 37 | 49 | 67 | " | " | " | " | 0 | None | No peeling | 0.00 |
| Working Example 10 | 350 mL | 21 inch | Composite ironing | 20 | 42 | 63 | " | " | 12.0 | " | 200 ppm | None | No peeling | 4.5 |
| Working Example 11 | 350 mL | 21 inch | Composite ironing | 20 | 42 | 63 | " | " | " | 180 | 50 ppm | None | Partial peeling | 5.0 |
| Working Example 12 | 350 mL | 21 inch | Composite ironing | 20 | 42 | 63 | Polyethylene | 20/20 | 0.52 | 220 | 150 ppm | Very small | No peeling | 2.5 |
| Working Example 13 | 350 mL | 21 inch | Composite ironing | 20 | 42 | 63 | Polypropylene | 20/20 | 0.75 | " | 100 ppm | Very small | No peeling | 4.4 |
| Working Example 14 | 350 mL | 21 inch | Composite ironing | 20 | 42 | 63 | PET/IA | 3/16 | 3.0 | 250 | 10 ppm | None | No peeling | 5.5 |
| Working Example 15 | 350 mL | 21 inch | Composite ironing | 20 | 42 | 63 | " | 16/2 | " | " | 20 ppm | None | No peeling | 3.0 |
| Working Example 16 | 350 mL | 21 inch | Composite ironing | 20 | 42 | 63 | " | 55/55 | " | 200 | 30 ppm | Very small | No peeling | 0.6 |
| Comparative Example 1 | 350 mL | 21 inch | Single | 31 | — | 63 | PET/IA | 16/16 | 3.0 | 250 | 0% | Occurs | No peeling | 0.12 |

-continued

| | | Tool, molding conditions | | | | | Organic resin coating | | | | Evaluation results | | | |
|---|---|---|---|---|---|---|---|---|---|---|---|---|---|---|
| | | | | Each sheet thickness reduction ratio of composite ironing die | | | | | | | | | | |
| | Can size | Punch stroke length | Initial ironing mode | Sheet thickness reduction ratio in ironing die on leading side (%) | Sheet thickness reduction ratio in ironing die on trailing side (%) | Final die Sheet thickness reduction ratio from original sheet thickness on side wall of final cup (%) | Type | Thickness (μm) inner surface/outer surface | Tensile modulus of elasticity (GPa) | Bonding strength of resin on inner surface (g/15 mm width) | Breakage occurrence ratio | Rollback | Peeling of organic resin coating material | Metal exposure on inner surface of can (mA) |
| Comparative Example 2 | 350 mL | 21 inch | " | 42 | — | 77 | " | " | " | " | 100% | — | — | — |
| Comparative Example 3 | 350 mL | 21 inch | " | 17 | — | 63 | " | " | " | " | 0% | Occurs | " | 3.2 |
| Comparative Example 4 | 350 mL | 21 inch | " | 13 | — | 63 | " | " | " | " | 30% | Occurs | " | 12 |
| Comparative Example 5 | 350 mL | 21 inch | " | 27 | | 63 | none | — | — | — | 30% | Occurs | — | — |
| Comparative Example 6 | 350 mL | 21 inch | " | 42 | | 63 | none | — | — | — | 820 ppm | None | — | — |
| Comparative Example 7 | 350 mL | 21 inch | Composite ironing | 27 | 43 | 66 | none | — | — | — | 710 ppm | None | — | — |
| Comparative Example 8 | 350 mL | 24 | Three entirely independent dies | 27 | 43 | 66 | none | — | — | — | 5 ppm | None | — | — |
| Comparative Example 9 | 350 mL | 21 inch | Composite ironing | 20 | 42 | 63 | E/P paint | 20/20 | — | — | 2.5% | Occurs | Peeling surface area increases | 132 |
| Comparative Example 10 | 350 mL | 21 inch | Composite ironing | 20 | 60 | 63 | PET/IA | 16/16 | 3.00 | 250 | 0.2% | None | no peeling | 1.2 |
| Comparative Example 11 | 350 mL | 21 inch | Composite ironing | 20 | 42 | 77 | " | " | " | " | 100% | Occurs | no peeling | — |
| Comparative Example 12 | 350 mL | 21 inch | Composite ironing | 20 | 27 | 63 | " | " | " | " | 10% | Occurs | No peeling | 2.4 |

Usually, when single ironing is implemented, the stroke length of a body maker has to be 24 inch for a 350 ml can and 26 inch for a 500 ml can.

Working Example 1, Working Example 2, and Working Example 8 are examples in which first ironing was conducted as single ironing, and Working Examples 3 to 7 and Working Example 9 are examples in which the first ironing was conducted as a simultaneous ironing by a composite ironing die. In other aspects, the aforementioned items had numerical values within the ranges set forth by the present invention as shown in Table 1. As for evaluation results relating to working examples, the can body breakage ratio was zero in all the examples, rollback was either absent or very small, no occurrence of organic resin coating material peeling was confirmed, and the exposure of metal on the inner surface of the can was 0.00 mA, that is, below the detection level in measurements with an enumerator.

By contrast, Comparative Example 1 is an example in which the first ironing die is a single die (equivalent to the embodiment shown in FIG. 2) with the sheet thickness reduction ratio (31%) being lower the range (35% to 55%) set forth by the present invention. The evaluation results confirmed the occurrence of rollback, which is buckling, in the opening edge section of the can, and the exposure of metal on the inner surface of the can was also confirmed to have a significant value of 0.12 mA.

Comparative Example 2 is an example relating to the case where the first ironing die is a single die, but the sheet thickness reduction ratio with the final ironing die (77%) is above the range set forth by the present invention. In the evaluation results, the can body breakage occurrence ratio was found to be 100%.

Comparative Example 3 and Comparative Example 4 are examples relating to the cases where the first ironing die is a single die and the sheet thickness reduction ratio is further reduced below that of Comparative Example 1 to 17% and 13%, respectively. The occurrence of rollback was observed in both example, and the can body breakage occurrence ratio of 30% was confirmed in Comparative Example 4.

Comparative Example 5 to Comparative Example 8 are examples relating to the cases where no organic resin coating was preformed. In Comparative Example 5, the first ironing die was a single ironing die and the sheet thickness reduction ratio (27%) was below the range (35 to 55%) specified by the present invention. The evaluation results demonstrated a can body breakage occurrence ratio of 30% and the occurrence of rollback was observed. In Comparative Example 6, the first ironing die was a single die, and the conditions were within the scope of the present invention, except that no organic resin coating was performed. The evaluation results demonstrated a breakage occurrence ratio of 820 ppm. Furthermore, in Comparative Example 7, the first ironing die was a composite ironing die, and the conditions were within the scope of the present invention, except that no organic resin coating was performed. The evaluation results demonstrated a can body breakage occurrence ratio of 710 ppm. In Comparative Example 8, three presently employed single ironing dies were used, and the conditions were within the scope of the present invention, except that no organic resin coating was performed. In this case the punch stroke length has to be longer than in the embodiment of the present application. The evaluation results demonstrated a can body breakage occurrence ratio of 5 ppm.

In Comparative Example 9 and all subsequent comparative examples, the first ironing dies were composite ironing dies. In Comparative Example 9, the organic resin coating film was from an epoxy phenol paint (abbreviated hereinbelow as E/P paint) (coating thickness on the inner/outer surface was 20/20 μm). The evaluation results in this case demonstrated a can body breakage occurrence ratio of 2.5% and the occurrence of rollback was also observed. The surface area from which the E/P paint was peeled was large, and the largest metal exposure on the inner surface of the can (132 mA) was observed.

In Comparative Example 10, the sheet thickness reduction ratio (60%) in the ironing die 14*b* on the trailing side of the composite ironing die was above the range (35 to 55%) specified by the present invention. The evaluation results demonstrated a can body breakage occurrence ratio of 0.2% and metal exposure on the inner surface of the can of 1.2 mA. In Comparative Example 11, the sheet thickness reduction ratio in the last ironing die (second ironing die) was above (77%) the range specified by the present invention. The evaluation results demonstrated a can body breakage occurrence ratio of 100%, and the occurrence of rollback was also observed.

In Comparative Example 12, the sheet thickness reduction ratio (27%) in the trailing side ironing die 14*b* of the composite ironing die was below the range (35 to 55%) specified by the present invention. The evaluation results demonstrated a can body breakage occurrence ratio of 10%, and the occurrence of rollback was also observed. Furthermore, a 2.4 mA metal exposure on the inner surface of the can was observed.

In Embodiment 10, the tensile modulus of elasticity of the organic resin coating film (12.0 GPa) was above the preferred range (1.45 GPa to 11.8 GPa) specified by the present invention. In this case, the can body breakage occurrence ratio was 200 ppm and no rollback has occurred.

In Embodiment 11, the adhesive strength of the resin on the inner surface of the organic resin coating film (180 g/15 mm width) was below the preferred range (200 g/15 mm width) specified by the present invention. In this case, part of the organic resin material peeled off and a 5 mA metal exposure was observed on the inner surface of the can.

In Embodiment 12 and Embodiment 13, the organic resin coating films were from different resins: polyethylene and polypropylene, respectively, and the tensile modules of elasticity (0.52 GPa and 0.75 GPa, respectively) were below the preferred range (1.45 GPa to 11.8 GPa) specified by the present invention. In this case, the can body breakage occurrence ratio was 150 ppm and 100 ppm, respectively. Furthermore, in both examples, light rollback was observed and the metal exposure on the inner surface of the can was 2.5 mA and 4.4 mA, respectively.

Furthermore, in Embodiments 14 to 16, the thickness of the organic resin coating film on the inner/outer surfaces was 3/16, 16/2, and 55/55 μm, respectively, and was outside the preferred range (5 to 50 μm/3 to 50 μm) specified by the present invention. In this case, in Embodiment 14 and Embodiment 15, the can body breakage occurrence ratio was 10 ppm and 20 ppm, respectively, and the metal exposure on the inner surface of the can was 5.5 mA and 3.0 mA, respectively. In Embodiment 16, the can body breakage occurrence ratio was 30 ppm and a light rollback and a 0.6 mA metal exposure on the inner surface of the can were observed.

INDUSTRIAL APPLICABILITY

In the embodiments of the present invention, the explanation was conducted with respect to cans manufactured by drawing and ironing an aluminum sheet covered with a resin, but the same effect can be also expected in the case of cans from other metals, for example, steel cans.

The invention claimed is:

1. A method for manufacturing a synthetic resin coated metal can body by drawing a metal sheet coated on both surfaces with a thermoplastic resin to obtain a cup body and then ironing a side wall of the cup body by using a punch and a plurality of ironing dies, wherein the ironing comprises a first ironing conducted with respect to the side wall of the cup body with a first ironing die at a processing quantity such that a sheet thickness reduction ratio from an original sheet thickness is within a range of 35 to 55% and a second ironing conducted with a second ironing die with respect to the side wall, which has been subjected to the first ironing, at a processing quantity such that a sheet thickness reduction ratio from the original sheet thickness is within a range of 60 to 75%.

2. The method for manufacturing a synthetic resin coated metal can body according to claim 1, wherein the first ironing die and the second ironing die are single ironing dies.

3. The method for manufacturing a synthetic resin coated metal can body according to claim 1, wherein at least the first ironing die from among the first ironing die and the second ironing die is a composite ironing die comprising a leading side ironing die and a trailing side ironing die arranged in a row in an ironing direction.

4. The method for manufacturing a synthetic resin coated metal can body according to claim 3, wherein the ironing of the side wall performed with the leading side ironing die is conducted at a processing quantity such that a sheet thickness reduction ratio from the original sheet thickness is within a range of 18 to 40%, and the ironing of the side wall performed with the trailing side ironing die is conducted at a processing quantity such that a sheet thickness reduction ratio from the original sheet thickness is within a range of 35 to 55%.

5. The method for manufacturing a synthetic resin coated metal can body according to any one of claims 1 to 4, wherein the metal sheet is an aluminum sheet.

6. The method for manufacturing a synthetic resin coated metal can body according to any one of claims 1 to 4, wherein the thermoplastic resin has a tensile modulus of elasticity of 1.45 to 11.8 GPa.

7. The method for manufacturing a synthetic resin coated metal can body according to claim 6, wherein the thermoplastic resin is a polyester resin.

8. The method for manufacturing a synthetic resin coated metal can body according to any one of claims 1 to 4, wherein the thermoplastic resin is coated on the metal sheet to a thickness of 5 to 50 μm on the side that is to be an inner surface side of the metal can body and to a thickness of 3 to 50 μm on the side that is to be an outer surface of the metal can body.

9. A device for manufacturing a synthetic resin coated metal can body by using a punch and a plurality of ironing dies and ironing a side wall of a cup body obtained by drawing a metal sheet coated on both surfaces with a thermoplastic resin, wherein the plurality of ironing dies comprise a first ironing die for conducting first ironing at a processing quantity such that a sheet thickness reduction ratio from an original sheet thickness is within a range of 35 to 55% and a second ironing die disposed at a distance equal to or slightly larger than the length of the metal can body obtained in the first ironing from the first ironing die and conducting second ironing with respect to the side wall, that has been subjected to the first ironing, at a processing quantity such that a sheet thickness reduction ratio from the original sheet thickness is within a range of 60 to 75%.

10. The device for manufacturing a synthetic resin coated metal can body according to claim 9, wherein the first ironing die and the second ironing die are single ironing dies.

11. The device for manufacturing a synthetic resin coated metal can body according to claim 9, wherein at least the first ironing die from among the first ironing die and the second ironing die is a composite ironing die comprising a leading side ironing die and a trailing side ironing die arranged in a row in an ironing direction.

12. The device for manufacturing a synthetic resin coated metal can body according to claim 11, wherein the ironing of the side wall performed with the leading side ironing die is conducted at a processing quantity such that a sheet thickness reduction ratio from the original sheet thickness is within a range of 18 to 40%, and the ironing of the side wall performed with the trailing side ironing die is conducted at a processing quantity such that the sheet thickness reduction ratio from the original sheet thickness is within a range of 35 to 55%.

13. The device for manufacturing a synthetic resin coated metal can body according to any one of claims 9 to 12, wherein the metal sheet is an aluminum sheet.

14. The device for manufacturing a synthetic resin coated metal can body according to any one of claims 9 to 12, wherein the thermoplastic resin has a tensile modulus of elasticity of 1.45 to 11.8 GPa.

15. The device for manufacturing a synthetic resin coated metal can body according to claim 14, wherein the thermoplastic resin is a polyester resin.

16. The device for manufacturing a synthetic resin coated metal can body according to any one of claims 9 to 12, wherein the thermoplastic resin is coated on the metal sheet to a thickness of 5-50 μm on the side that is to be an inner surface side of the metal can body and to a thickness of 3-50 μm on the side that is to be an outer surface of the metal can body.

* * * * *